United States Patent [19]

Kenney et al.

[11] Patent Number: 4,473,103

[45] Date of Patent: Sep. 25, 1984

[54] CONTINUOUS PRODUCTION OF METAL ALLOY COMPOSITES

[75] Inventors: Malachi P. Kenney, Chesterfield; Kenneth P. Young, Ballwin; Alan A. Koch, Overland, all of Mo.

[73] Assignee: International Telephone and Telegraph Corporation, New York, N.Y.

[21] Appl. No.: 344,206

[22] Filed: Jan. 29, 1982

[51] Int. Cl.[3] ..... B22D 19/16

[52] U.S. Cl. ..... 164/97; 164/900

[58] Field of Search ..... 164/55.1, 57.1, 71.1, 164/77, 97, 133, 136, 461, 473, 488, 900

[56] References Cited

U.S. PATENT DOCUMENTS

| | | | |
|---|---|---|---|
| 3,110,939 | 11/1963 | Lockwood | 164/97 |
| 3,305,902 | 2/1967 | Bjorksten | 164/55.1 |
| 3,521,698 | 7/1970 | Colombo | 164/136 |
| 3,600,163 | 8/1971 | Badia et al. | 164/97 X |
| 4,330,027 | 5/1982 | Narasimhan | 164/461 |

FOREIGN PATENT DOCUMENTS

| | | | |
|---|---|---|---|
| 225362 | 1/1963 | Austria | 164/47 |
| 1166421 | 3/1964 | Fed. Rep. of Germany | 164/57.1 |
| 1245049 | 7/1967 | Fed. Rep. of Germany | 164/133 |
| 1543206 | 3/1979 | United Kingdom | 164/71.1 |
| 770650 | 10/1980 | U.S.S.R. | 164/490 |

*Primary Examiner*—Kuang Y. Lin

*Attorney, Agent, or Firm*—James B. Raden; Harold J. Holt

[57] ABSTRACT

A process and apparatus for the continuous production of shaped aluminum alloy-particulate composites. The process comprises metering at a substantially constant ratio a particulate solid molten aluminum alloy containing at least 0.10% by weight of magnesium into a mixing station while continuously vigorously agitating to produce a homogeneous mixture, simultaneously discharging from the mixing station a homogeneous mixture of molten aluminum alloy and particulate solid, transferring the mixture to a forming station and shaping and solidifying the composite.

10 Claims, 1 Drawing Figure

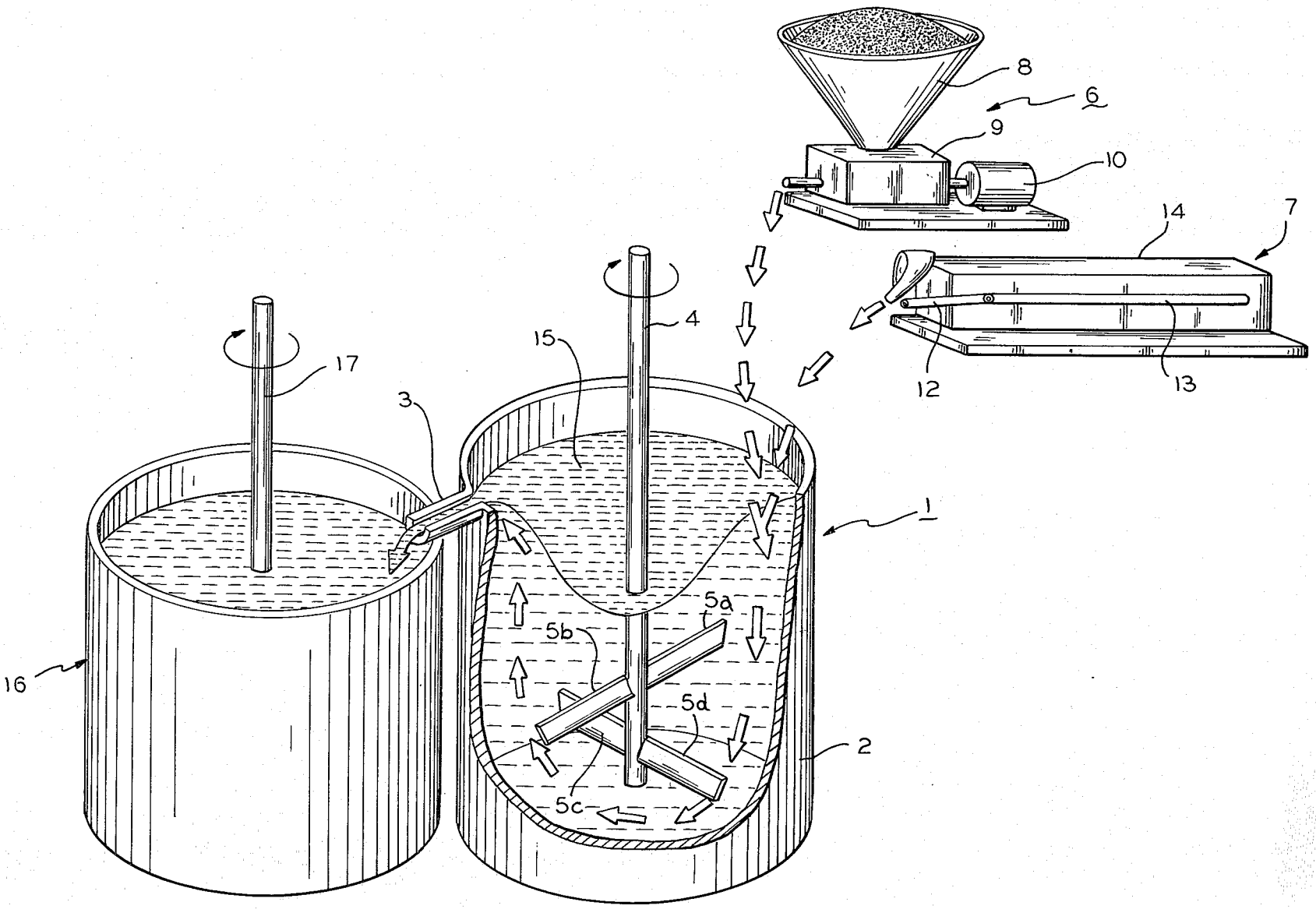
7
14
13
10
6
8
9
12
1
2
5a
5d
4
15
5b
5c
3
17
16

CONTINUOUS PRODUCTION OF METAL ALLOY COMPOSITES

This invention relates to a process for the continuous production of metal alloy-particulate composites and to a high temperature mixer for use therewith.

The addition of non-wetting solid particles to metal alloy compositions has often been attempted to modify the strength, hardness or other characteristics of the alloy compositions. As U.S. Pat. No. 3,951,651 to Mehrabian et al points out, such additions are difficult to accomplish because the alloy rejects such non-wetting particles and as a result the particles do not homogeneously disperse in the alloy. The Mehrabian et al patent discloses a process for overcoming the rejection problem by vigorously agitating a liquid-solid metal alloy mixture to form a semi-solid slurry and then dispersing the solid particles in the slurry.

It has also been suggested that the solid particles be coated with a metal which is wetted by the molten metal alloy. For example, U.S. Pat. No. 3,753,694 to Badia et al discloses a process for enveloping the metallurgically incompatible particles with a coating which wets the metal alloy and then adding the coated particles to a molten bath of the metal while the latter is subjected to the influence of a vortex. Rohatgi et al, in the Journal of Materials Science, 14 (1979) pages 2277–2283, discloses that the addition of 3.5 weight % magnesium to an aluminum alloy imparts some wettability to silica particles and permits the addition of as much as 2.5% silica to aluminum. Other patents, such as U.S. Pat. Nos. 2,793,949 and 3,028,234, disclose related processes for dispersing inorganic or refractory oxide particles into molten metals.

In so far as is known, all of the prior art processes for introducing dispersed solid particles into metals or metal alloys are discontinuous or batch processes in which stirring occurs for a finite period and the resulting mixture is then solidified or shaped and solidified. That all such prior art processes are batch processes is not surprising in view of the very great difficulty of both maintaining and preserving throughout the processing cycle a homogeneous mixture of alloy and dispersed particles. In the case of aluminum-sand dispersions, for example, the surface tension of the aluminum tends to make the sand float so that the production of such composites on a continuous basis presents a number of major difficulties.

It is accordingly a major object of the present invention to provide a continuous process and apparatus for the production of shaped composites of a metal alloy containing a particulate solid uniformly dispersed therein.

It is an additional object of the present invention to provide a process and apparatus for producing shaped aluminum alloy parts at substantially reduced costs without substantial sacrifice of the properties of the aluminum alloy.

It is an additional object of the invention to provide a process for producing aluminum alloy-particulate composites which uses a completely uncoated particulate solid and which does not require the use of a liquid-solid alloy slurry.

It is a more specific object of this invention to provide a low cost aluminum die casting containing a substantial proportion of sand dispersed homogeneously throughout the casting.

A shaped composite of an aluminum alloy and a particulate solid other than an aluminum alloy are produced in accordance with the invention in a continuous process comprising metering into a mixing station, at a substantially constant ratio by weight, the particulate solid in uncoated form and molten aluminum alloy containing at least 0.10% by weight of magnesium while the aluminum alloy and particulate solid are continuously vigorously agitated at a shear rate sufficient to produce a homogeneous mixture of molten aluminum alloy and particulate solid, simultaneously with said metering step continuously discharging from the mixing station a homogeneous mixture of molten aluminum alloy and particulate solid, transferring the discharged homogeneous aluminum alloy-particulate mixture while still molten to a forming station and shaping and solidifying the aluminum alloy-particulate composite. The product of the process is a shaped and solidified aluminum alloy composite containing a particulate solid uniformly dispersed therein.

The invention also comprises a high temperature mixer for use in the continuous process, the mixer comprising means for containing a mixture of particulate solid and a molten metal alloy, means in association with the containing means for the vigorous agitation of the particulate solid and molten alloy at a shear rate sufficient to produce a homogeneous mixture of the particulate solid and molten alloy, the agitation means comprising a rotatable shaft extending vertically into the container having a plurality of mixing blades mounted thereon, the mixing blades being mounted in pairs and extending horizontally from the shaft, each of the blades being angled from the vertical in a direction opposite from the other blade of said pair, means in association with an upper portion of the mixer for the continuous introduction of predetermined amounts of particulate solid and molten alloy into the container at a substantially constant ratio, and discharge means for the continuous discharge of a homogeneous mixture of molten alloy and particulate solid from the mixer.

In the preferred practice of the invention, the homogeneous mixture continuously discharged from the mixing station is discharged into a holding station prior to its transfer to the forming station. The mixture is continuously agitated in the holding station while the temperature of the alloy is maintained above the liquidus temperature, the agitation being sufficient to maintain the mixture homogeneous and to substantially prevent adverse chemical reaction between the alloy and the particulate solid. The holding station acts as a buffer to insure continuity of the process from the mixing station to the forming station.

BRIEF DESCRIPTION OF THE DRAWING

The invention will be better understood by reference to the accompanying drawing in which the single FIGURE is a schematic diagram of a continuous composite mixer and associated feeding devices useful in the invention.

The present invention is particularly directed to the low cost production of non-load bearing castings of aluminum alloys. Examples of such products are electrical housings, oil pans and valve covers. Even a scale-up of prior art batch processes for producing aluminum alloy composites would not be adequately cost-effective for the production of such products. Such scaled-up batch processes would still require a significant amount of manpower to maintain production and would be inflexible in terms of coupling with a forming or shaping system that operates on a continuous cycle. Moreover, certain aluminum-particulate mixtures are chemically reactive at the melt temperatures involved in producing the composites and the continuous mode of operation minimizes the extent of reaction since high temperature hold times prior to shaping are of short duration.

The invention is useful for the production of a wide variety of aluminum alloy-particulate composites. The particulate should be a solid, other than an aluminum alloy, which is substantially insoluble in the molten aluminum alloy at the processing temperatures. Examples of such particulates are graphite, metal carbides, metal oxides and ceramics including silicates and aluminosilicates. The process is particularly useful for preparing aluminum alloy-silica sand composites and will be so illustrated in the following discription of the invention.

In the practice of the invention, aluminum alloy is first melted in a melt or breakdown furnace by heating to a temperature above the liquidus temperature (about 1100°-1300° F. depending on the specific alloy). Uncoated sand is fed continuously through a metering unit and molten aluminum alloy, is fed, either incrementally such as through an autoladle, or continuously into a processor or mixing furnace equipped with a stirring mechanism. The sand is metered into the mixture at a continuous but controlled and uniform rate so that essentially each sand particle contacts the molten aluminum alloy independently. The sand and aluminum alloy are metered in proportions necessary to obtain the aluminum alloy-sand ratio desired in the final composite.

In the processor or mixing furnace, the alloy-sand mixture is vigorously agitated at a shear rate sufficient to produce a homogeneous mixture. Agitation may be accomplished by a mechanical mixer of the type shown in the drawing and this mixer and its method of use constitutes the preferred practice of the invention. As shown in the drawing, the mixer 1 comprises a containing means 2 having a slightly angled discharge port and channel 3. Vertically disposed at the center of said container is a shaft 4 rotatable directly or indirectly through suitable linkage to a motor (not shown). Mounted on the lower portion of the shaft are a plurality of mixing blades 5*a*, 5*b*, 5*c* and 5*d*. The blades have the same configuration and dimensions but are mounted in pairs extending horizontally from the shaft, each of the blades being angled from the vertical in a direction opposite from the other blade of the pair. In addition, paired blades 5*a* and 5*b* are mounted vertically above and 90° offset from paired blades 5*c* and 5*d*. It has been found that this blade configuration is important to the production of a homogeneous mixture of the molten alloy and sand. Sand is continuously metered in by a sand-feeder 6 and aluminum by an autoladle 7. Sand-feeder 6 comprises a funnel-shaped hopper 8 which delivers sand into a receptacle 9 where a helical screw turned by motor 10 meters sand into container 1 at a constant rate. Autoladle 7 comprises a ladle 11 pivotally mounted at one end of an arm 12. Arm 12 is in turn pivotally mounted at its other end in a track 13 in the body 14 of the autoladle. Ladle 11 picks up molten alloy from a melt furnace (not shown), traverses the autoladle and discharges the alloy into mixer 1. A mixing speed of from 300 to 600 rpm has been found to be satisfactory for producing a homogeneous mixture of alloy and particulate solid in accordance with the invention. Rotation of the mixer at this speed produces sufficient centrifigal force to expel the mixture 15 into channel 3 where it flows by gravity into the holding station.

Alternatively, in place of the mechanical mixer shown in the drawing, agitation of the aluminum alloy-particulate mixture may be accomplished by use of a rqtating magnetic field of the type disclosed in copending U.S. application Ser. No. 015,250, filed Feb. 26, 1979 and assigned to the present assignee. In that application, a two pole induction motor stator is arranged circumferentially around a mold. The stator creates a rotating magnetic field across the mold and provides a magnetomotive stirring force which causes the molten metal to rotate. The copending application discloses the vigorous agitation of a slurry rather than a completely molten alloy. However, the mixing process and apparatus is equally useful with molten metal alloys. The disclosure of the afore-mentioned copending U.S. application is hereby incorporated by reference.

Normally, the uncoated sand and molten aluminum alloy will be introduced at an upper portion of the high temperature mixer. As shown in the drawing, the continuous vigorous mixing action will create a continuous flow of the alloy-sand mixture from the introduction area to the bottom of the processor and from there to an upper portion of the processor, opposite its point of introduction. Here the mixture, which now contains a homogeneous dispersion of the alloy and sand in the desired ratio by weight, is expelled by the centrifigal force of the mixing action and flows by gravity down discharge channel 3 into a holding reservoir 16 where it is stirred by a mechanical mixer 17. The mixture in the holding reservoir is maintained above the liquidus temperature of the alloy, preferably at the temperature at which the final composite will be shaped.

The mixture in the holding reservoir is also continuously agitated, although less vigorously than in the processor. Agitation may be either mechanical or magnetic stirring means as in the case of the processor. Agitation in the holding reservoir accomplishes several purposes. Aside from maintaining the homogeneity of the alloy-sand mixture, it keeps the sand particles from remaining in proximity to the surface of the holding crucible which is normally several hundred °F. higher than the mixture. This substantially reduces or prevents adverse chemical reactions between the alloy and sand or other particulate. Agitation by mechanical means in the holding reservoir will normally be at from 200 to 400 rpm depending on the aluminum alloy used, the proportion of particulate solid and the specific configuration of the mixing device. Mixing is less vigorous in the holding reservoir and the configuration of the mixer and its speed is less critical than in the high temperature mixer.

From the holding reservoir, the alloy-sand mixture is ladled in known fashion to a die casting machine or other shaping apparatus.

Agitation of the alloy-particulate mixture in the processor must be at a shear rate sufficient to produce a uniform or homogeneous mixture. It should be noted that excessive amounts of magnesium tend to embrittle aluminum alloys and also to reduce the flow of the alloy-particulate mixtures so that they cannot be die cast. It has been found that sufficient agitation of the aluminum alloy-particulate mixture reduces the amount of magnesium required. In general, it is desirable that the mixing speed or magnetomotive force in the mixer be sufficient to provide a shear rate of 200 sec.$^{-1}$ to 800 sec.$^{-1}$. The process generally requires the use of less than 10 weight %, and its most preferred form, less than 1 weight % magnesium.

Homogeneous, sound die castings have been made on a continuous basis containing from 1 to 50% by weight of particulate solid, based on the total casting weight. For nonload bearing die castings, of the type for which the process of invention is particularly suitable, the proportion of particulate solid will normally be established in the range of 15 to 40% by weight. Such an amount is unusually high, particularly in an aluminum alloy composite containing relatively low amounts of magnesium.

The following example illustrates the practice of the invention. All parts and percentages, unless otherwise indicated, are by weight.

EXAMPLE

An aluminum alloy of the following composition was used to produce a die cast housing for an electrical component:

| S | Fc | Cu | Mn | Mg | Ni | 2n | Sn | Others |
|---|---|---|---|---|---|---|---|---|
| 10.5–12.0 | 1.0 | 3.0–4.5 | 0.50 | 0.10 | 0.50 | 3.0 | 0.35 | 0.50 |

The composition was adjusted to a magnesium content of 0.5%. The alloy was melted in a melt furnace at a temperature of 1125° F. Molten aluxinum alloy was ladled from the melt furnace to a mixing furnace at the rate of two pounds per minute. Commercial grade uncoated silica sand at room temperature was added on a continuous basis to the mixing furnace at the rate of 0.5 pounds per minute with an automatic feeder. The mixing furnace had a mechanical agitator of the type shown in the drawing which was rotated at 450 rpm. Temperature of the mixing furnace was maintained at 1100° F. with an automatic temperature control. The centrifigal mixing force was sufficient to expel alloy-sand mixture by gravity into a holding reservoir in which the temperature was maintained at 1200° F.

Increments of approximately two pounds of alloy-sand mixture were then hand ladled from the reservoir and poured into the shot chamber of a 600-ton die casting machine.

The mixture was then injected, using standard procedure, into the die cavity forming a housing. Injection plunger velocity was 65" per second and die temperatures were maintained at 400° F. Total injection and forming cycle was 29 seconds, with 8 seconds dwell time from injection to extraction of the part from the die.

The housing produced had a nominal wall thickness of 0.60" and a finished weight of 1.1 pounds. The surface finish of the castings was found to be identical to those produced from aluminum alloy and with an as-cast ultimate tensile strength of 20,000 psi. Conversion resistance of the casting was found to be comparable to an equivalent aluminum alloy casting.

This process is useful for many types of products. In the case of aluminum-sand in which tensile performance is reduced, non-structural products are suitable. If other particulates are used, however, such as graphite (lubricity) or SiC (strength), a wide variety of property enhancement can be affected.

We claim:

1. A continuous process for the production of a shaped composite of an aluminum alloy and a particulate solid other than an aluminum alloy comprising metering into a mixing station, at a substantially constant ratio by weight, the particulate solid in uncoated form and molten aluminum alloy containing at least 0.10% by weight of magnesium while said aluminum alloy and particulate solid are continuously vigorously agitated at a shear rate sufficient to produce a homogeneous mixture of molten aluminum alloy and particulate solid, simultaneously with said metering step continuously discharging a homogeneous mixture of molten aluminum alloy and particulate solid into a holding station, said mixture being continuously agitated in said holding station while the temperature of the alloy is maintained above the liquidus temperature, said agitation being at a shear rate of at least 200 sec.$^{1}$ and being sufficient to maintain the mixture homogeneous and to substantially prevent chemical reaction between the alloy and said particulate solid, tranversing said molten aluminum alloy-particulate mixture while still homogeneous to a forming station and shaping and solidifying said aluminum alloy-particulate composite at said forming station into a shaped part containing a particulate solid uniformly dispersed therein.

2. The process of claim 1 in which the particulate solid is silica sand.

3. The process of claim 1 in which the particulate solid is continuously metered into said mixing station and the molten aluminum alloy is incrementally metered into said mixing station.

4. The process of claim 1 in which the aluminum alloy contains from 0.10 to 10% by weight of magnesium.

5. The process of claim 5 in which the aluminum alloy contains from 0.2 to 1% by weight of magnesium.

6. The process of claim 1 in which the particulate solid comprises from 1 to 50% by weight of the total weight of the aluminum alloy-sand composite.

7. The process of claim 7 in which the particulate solid comprises from 15–40% by weight of the total weight of the aluminum-particulate composite.

8. The process of claim 1 in which the aluminum alloy-particulate composite is shaped by die casting.

9. The process of claim 1 in which said vigorous agitation produces sufficient centrifigal force to continuously discharge the aluminum-sand mixture from the mixing station.

10. A continuous process for the production of a shaped aluminum alloy-sand composite comprising metering into a mixing station, at a substantially constant ratio by weight, uncoated sand and molten aluminum alloy containing from 0.10% to 10% by weight of magnesium while said aluminum and sand are continuously vigorously agitated at a shear rate sufficient to produce a homogeneous mixture of molten aluminum alloy and sand, simultaneously with said metering step continuously discharging from said mixing station into a holding station a homogeneous mixture of molten aluminum alloy and sand, said mixture being continuously agitated in said holding station while the temperature of the alloy is maintained above the liquidus temperature, said agitation being at a shear rate of at least 200 sec.$^{-1}$ and being sufficient to maintain the mixture homogeneous and to substantially prevent chemical reaction between the alloy and sand, transferring said homogeneous aluminum alloy-sand mixture while still molten to a forming station and shaping and solidifying said aluminum alloy-sand composite at said forming station into a non-load bearing shaped part, the sand comprising from 15–40% by weight of the total weight of the composite and uniformly dispersed therein.

* * * * *

UNITED STATES PATENT AND TRADEMARK OFFICE

CERTIFICATE OF CORRECTION

PATENT NO. : 4,473,103

DATED : Sept. 25, 1984

INVENTOR(S) : M.P. Kenney, K.P. Young and A.A. Koch

It is certified that error appears in the above-identified patent and that said Letters Patent are hereby corrected as shown below:

Column 6, line 23, cancel "tranversing" and substitute --transferring--.

line 38, cancel the numeral "5" following the word "claim" and substitute --4--.

line 43, cancel the numeral "7" following the word "claim" and substitute --6--.

Signed and Sealed this

*Twentieth* Day of *August 1985*

[SEAL]

*Attest:*

DONALD J. QUIGG

*Attesting Officer* *Acting Commissioner of Patents and Trademarks*